US008783047B2

(12) United States Patent
Tippmann

(10) Patent No.: US 8,783,047 B2
(45) Date of Patent: Jul. 22, 2014

(54) RACK-AISLE FREEZING SYSTEM FOR PALLETIZED PRODUCT

(75) Inventor: Daniel J. Tippmann, Fort Wayne, IN (US)

(73) Assignee: Tippmann Engineering LLC, Fort Wayne, IN (US)

( * ) Notice: Subject to any disclaimer, the term of this patent is extended or adjusted under 35 U.S.C. 154(b) by 345 days.

(21) Appl. No.: 12/877,392

(22) Filed: Sep. 8, 2010

(65) Prior Publication Data

US 2013/0255288 A1 Oct. 3, 2013

Related U.S. Application Data

(60) Provisional application No. 61/241,065, filed on Sep. 10, 2009.

(51) Int. Cl.
*F25D 17/02* (2006.01)

(52) U.S. Cl.
USPC ..... 62/99; 62/406

(58) Field of Classification Search
CPC ..... F25D 17/02; F25D 3/12; F25D 31/002; F25D 17/065; F25D 17/045; F25D 2400/04; F25D 17/062; F25D 16/00; F25D 3/04; F25D 23/025; F25D 23/003; F25D 23/061; F25D 2201/126; F25D 2317/0683; F25B 39/02; F25B 49/002; F25B 49/022; F24F 5/0017; B60H 1/00371; B60H 2001/00221; B61D 27/009; Y02E 60/147; F25F 5/0017; A47F 3/0404
USPC ..... 62/99, 406, 408, 419, 290.201, 436, 62/265, 89, 426, 440; 454/100, 173
See application file for complete search history.

(56) References Cited

U.S. PATENT DOCUMENTS

| | | | | |
|---|---|---|---|---|
| 206,140 | A | 7/1878 | Rumbaugh | |
| 239,345 | A | 3/1881 | Sanford | |
| 677,536 | A | 7/1901 | Cooper | |
| 1,813,187 | A | 7/1931 | Moore | |
| 2,240,377 | A | 4/1941 | Preble | |
| 3,545,223 | A | 12/1970 | Elland | |
| 3,621,672 | A | 11/1971 | Meredith | |
| 3,972,279 | A | 8/1976 | Powers | |
| 4,063,432 | A | 12/1977 | Chaussy et al. | |
| 4,082,194 | A * | 4/1978 | Sheehan | 414/792 |

(Continued)

OTHER PUBLICATIONS

Planning and Engineering Data. 3. Fish Freezing, U.S. Fisheries and Aquaculture Department, 1984.

(Continued)

*Primary Examiner* — Mohammad M Ali
(74) *Attorney, Agent, or Firm* — Faegre Baker Daniels LLP

(57) ABSTRACT

An installation and method for freezing and cold storage of palletized product. A chiller is provided in the interior of a cold storage warehouse space that maintains the temperature of ambient air within the space below freezing. A plurality of racking structures each define an air flow chamber having air intake openings on opposite sides thereof and an air outlet to enable freezing air to be drawn into the chamber through the intake openings and exhausting into the warehouse space. Pallets on pallet guides are pressed against the intake openings such that freezing air is drawn through the palletized product to thereby quickly freeze the product. The pallet structure and air flow chambers are arranged in spaced-apart rows to enable a forklift to pass down the aisles so as to place and remove the palletized product.

20 Claims, 10 Drawing Sheets

(56) References Cited

U.S. PATENT DOCUMENTS

| | | | | |
|---|---|---|---|---|
| 4,425,768 | A | 1/1984 | Burns | |
| 4,824,685 | A * | 4/1989 | Bianco | 426/418 |
| 4,989,417 | A | 2/1991 | Markiewicz | |
| 5,054,291 | A | 10/1991 | Davis et al. | |
| 5,215,421 | A * | 6/1993 | Smith | 414/276 |
| 5,401,520 | A | 3/1995 | Skaar et al. | |
| 5,520,006 | A | 5/1996 | Middleton | |
| 5,778,557 | A * | 7/1998 | Leavens | 34/222 |
| 5,893,218 | A * | 4/1999 | Hunter et al. | 34/492 |
| 5,965,185 | A * | 10/1999 | Bianco | 426/449 |
| 6,012,384 | A * | 1/2000 | Badalament et al. | 99/475 |
| 6,405,644 | B1 * | 6/2002 | Windecker | 99/468 |
| 6,419,087 | B1 * | 7/2002 | Peters | 206/423 |
| 6,431,060 | B1 * | 8/2002 | Gutheim | 99/475 |
| 6,443,056 | B1 * | 9/2002 | Kiefer et al. | 99/475 |
| 6,615,908 | B1 * | 9/2003 | Bosher et al. | 165/48.1 |
| 6,901,768 | B1 * | 6/2005 | Windecker | 62/407 |
| 6,923,111 | B2 * | 8/2005 | Kiefer et al. | 99/468 |
| 7,017,366 | B2 | 3/2006 | Bottom | |
| 7,178,356 | B1 | 2/2007 | Lingelbach | |
| 7,516,624 | B2 * | 4/2009 | Weeth | 62/419 |
| 7,946,124 | B2 * | 5/2011 | Klysen | 62/259.1 |
| 2004/0177792 | A1 | 9/2004 | Salmanson et al. | |
| 2006/0185528 | A1 | 8/2006 | Tippmann et al. | |
| 2006/0207284 | A1 | 9/2006 | Lehmann et al. | |
| 2006/0272350 | A1 | 12/2006 | Weeth | |
| 2007/0169503 | A1 | 7/2007 | Kikuchi et al. | |
| 2008/0178616 | A1 * | 7/2008 | Klysen | 62/89 |
| 2011/0107784 | A1 | 5/2011 | Tippmann et al. | |

OTHER PUBLICATIONS

Thermal Tech Acquires Cool Care, Thermal Tech News, vol. 5, No. 1, Spring 2002.

Go Tarpless!, Thermal Technologies Incorporated, 2004.

Office Action dated Mar. 18, 2013 in U.S. Appl. No. 12/879,521.

Response to Office Action dated Jun. 18, 2013 in U.S. Appl. No. 12/879,521.

University of California, "Commercial Cooling of Fruits, Vegetables, and Flowers", Revised Edition 2002, e.g., Chapter 2, Forced-Air Cooling, including Figure 7.

Heldman, Dennis R., "Optimizing the Food Freezing Process for Maximum Product Quality", WFLO Research Project #144, Sep. 2003.

Office Action dated Nov. 21, 2013 in U.S. Appl. No. 12/879,521.

Response to Office Action dated Jan. 22, 2014 in U.S. Appl. No. 12/879,521.

Office Action dated Feb. 13, 2014 in U.S. Appl. No. 12/879,521.

* cited by examiner

PRODUCT
PRODUCT
PRODUCT

RACK-AISLE FREEZING SYSTEM FOR PALLETIZED PRODUCT

This application claims the benefit under Title 35, U.S.C. §119(e) of U.S. Provisional Patent Application Ser. No. 61/241,065, titled RACK-ISLE FREEZING SYSTEM FOR PALLETIZED PRODUCT, filed on Sep. 10, 2009, the disclosure of which is expressly incorporated by reference herein.

The present disclosure relates to a warehouse or structure that mass freezes and stores bulk foods and other products.

Figure 1:
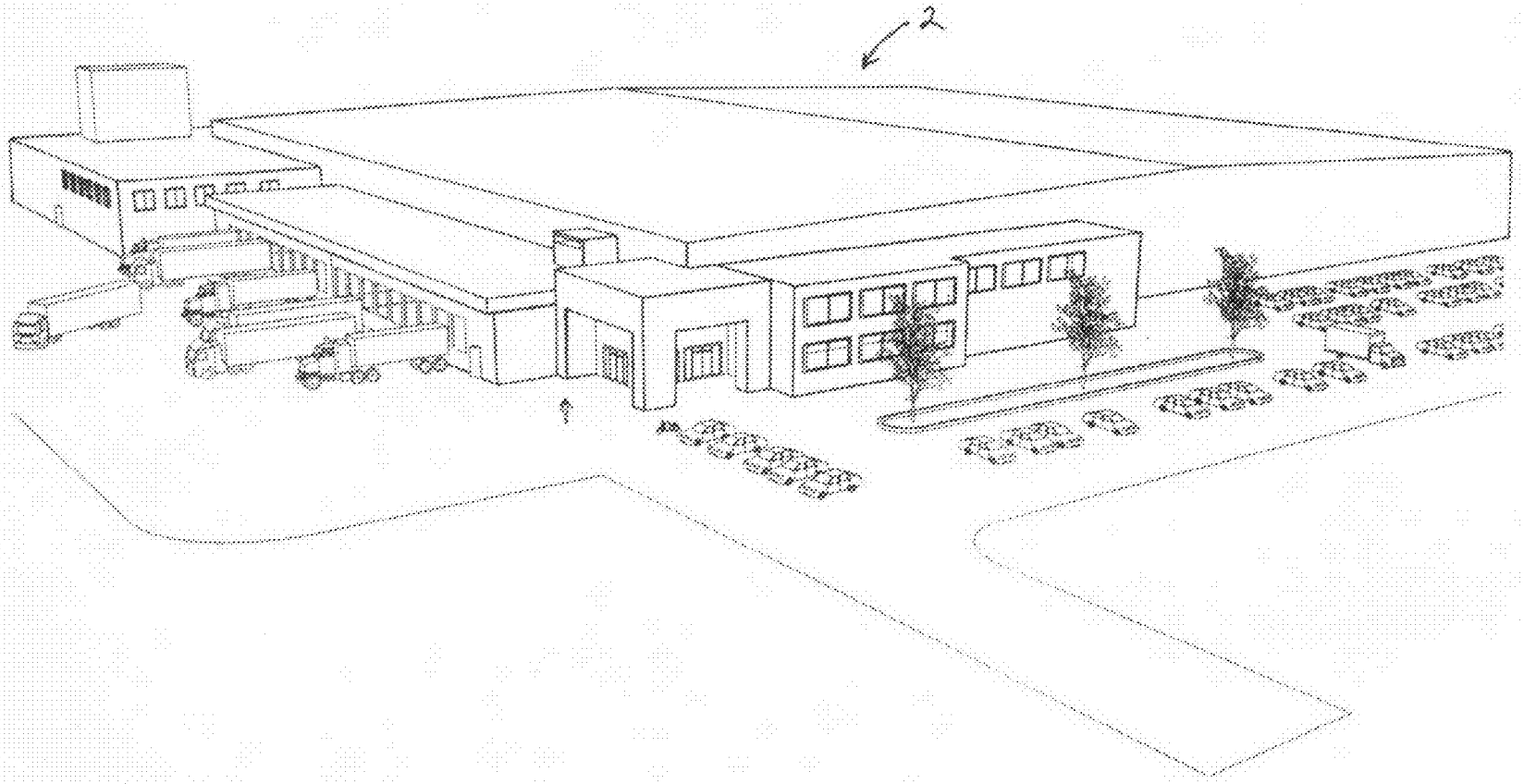
FIG. 1 is a perspective view of a warehouse incorporating a freezing system in accordance with the present disclosure.

According to the present disclosure, a large warehouse, building, or structure, such as warehouse 2 shown in FIG. 1, is used as a giant freezer that both freezes and maintains perishable foods or like products. Large pallets of items such as meats, fruits, vegetables, and prepared foods can be taken to this warehouse and promptly frozen in blast rooms. The product is then moved to the storage part of the warehouse where it is maintained at a frozen temperature until removed.

Unlike two-stage freezer warehouses, this disclosure describes a specially configured rack system that assists freezing the product directly in the open warehouse space. In essence, the system described herein is a one-stage freezing storage system, rather than a multi-stage freezing storage system. It is appreciated that fresh-packed fruits, vegetables, and other products can be chilled to a desired temperature.

Figure 2:
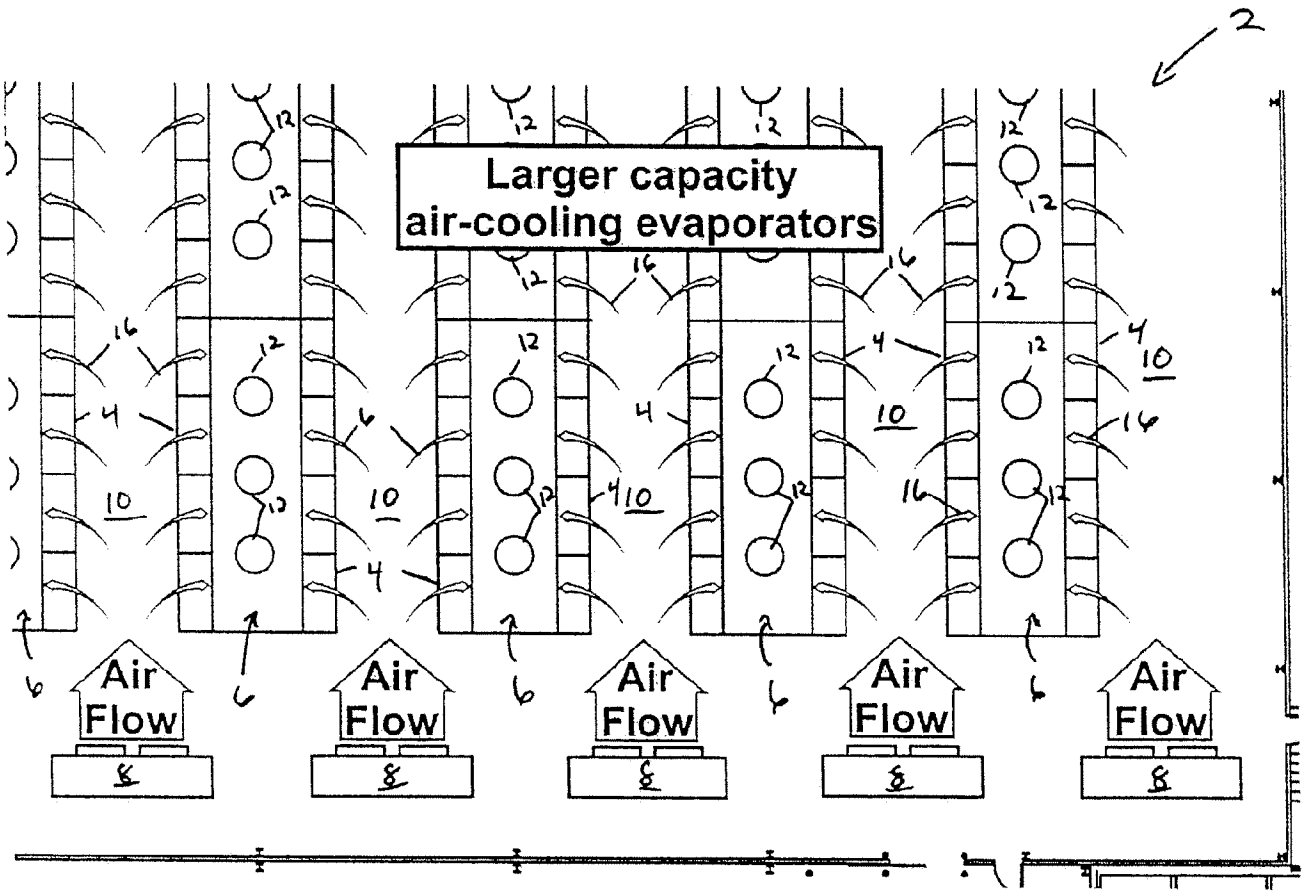
FIG. 2 is a diagrammatic top view of a freezer warehouse incorporating the system of the present disclosure.

A top view of the inside of warehouse 2 shown in FIG. 2 depicting several rows of palleted product. Each pallet 4 abuts a chamber 6. In this illustrative embodiment, pallets 4 are positioned several high on opposing sides and along chamber 6. Cold air produced in warehouse 2 is drawn through spacers 20 (see FIG. 6) separating rows of cases of product on the pallet. This air cools the product down while being drawn into chamber 6 indicated by directional arrow 16. In an illustrative embodiment, and as further discussed herein, openings 30 along the periphery of chamber 6 mate with cases 22 on the pallets 4 (see FIG. 9). The only significant way to move the cold air inside warehouse 2 is by going through and/or around the product on pallet 4. The air 16 drawn into chamber 6 can then be recooled and recirculated, or exhausted. Because the cold air moves around product prior to entering chamber 6, it provides an efficient means for freezing.

Chillers 8 inside warehouse 2 produce the cold air that flows through aisles 10 and into chambers 6. It is appreciated that chillers 8 can be positioned in different locations as needed inside warehouse 2. As shown in FIG. 2, chillers 8 are positioned remotely from chambers 6. The chilled air passes through open spaces near or through cases of product in order to enter chamber 6. Air handlers, such as fans 12 inside or in air flow communication with chamber 6 assist in drawing the air within warehouse 2 through the palletized and/or through the product cases and into the channel. Continuing this process freezes the product as well as maintains its frozen condition. Without blast freezers that initially freeze product only to then move it to warehouse aisles, more space can be dedicated to either more rows of chambers 6 or more aisle space 10. Increasing capacity or maneuvering room in a warehouse is beneficial.

Figure 3:
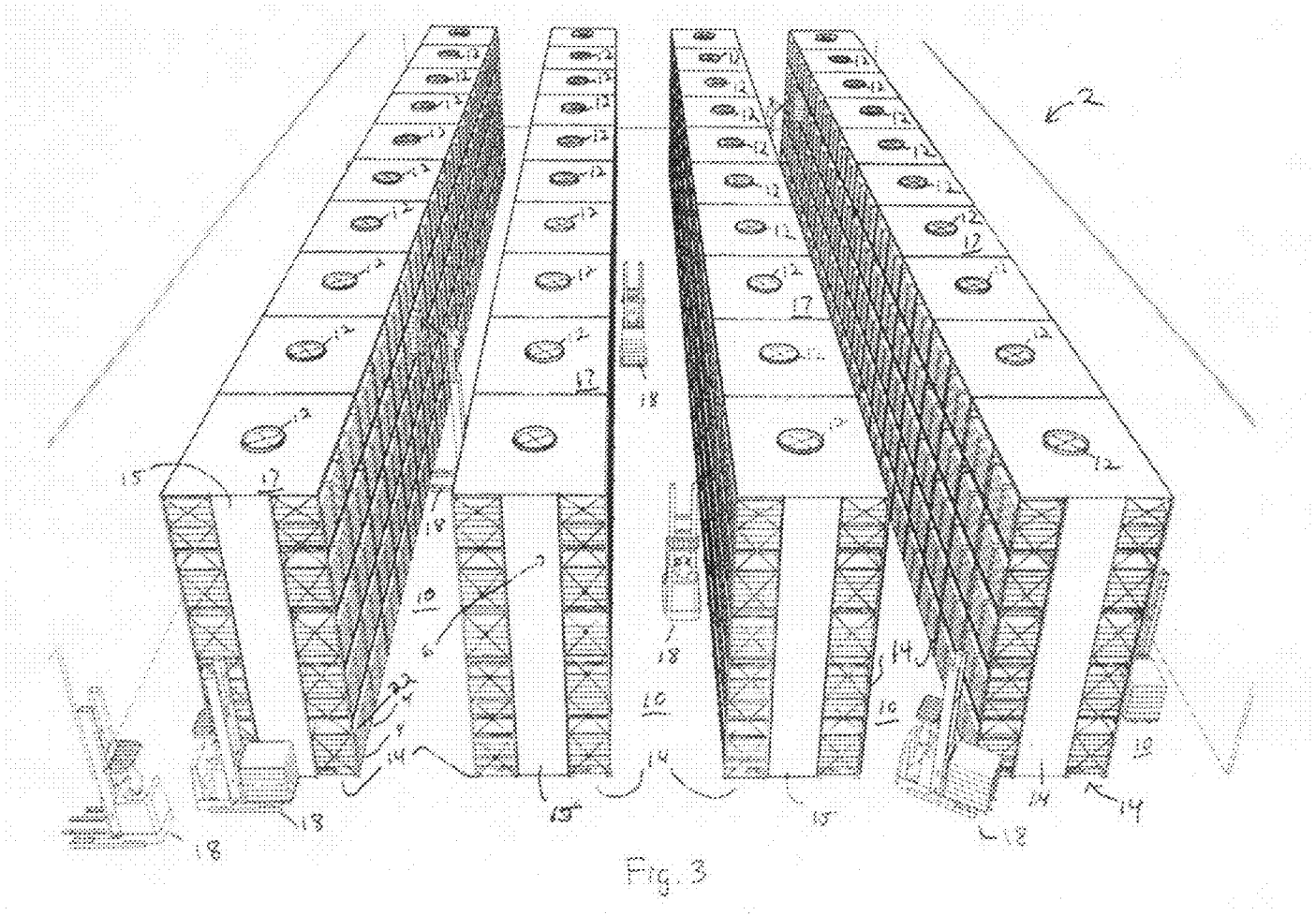
FIG. 3 is a perspective view of the interior of the freezer warehouse.

A top perspective view of the inside of warehouse 2 is shown in FIG. 3, This view shows rows of racking 14 between aisles 10 and chamber 6. In this view the actual chambers 6 are obscured because end caps 15 are covering their ends. A plurality of fans 12 are shown at the top with top panel 17 covering chamber 6. This view demonstrates how aisles 10 can be widened to accommodate more forklifts 18. This view also shows how many cases of product on pallets 4 can be stacked in these rows. In this illustrative embodiment, the pallets are stacked five high. This number can vary, however, depending on the needs of the warehouse and the size, configuration, and weight of the cases on the pallets. The space savings can also be appreciated from this view. The entire warehouse uses the same rows to both cool and store palleted product. This is more efficient than a conventional warehouse having separate blast freezing rooms. This new configuration not only requires less space, but it also no longer requires transporting the pallet from the blast room to a separate storage location in the warehouse.

Figure 4:
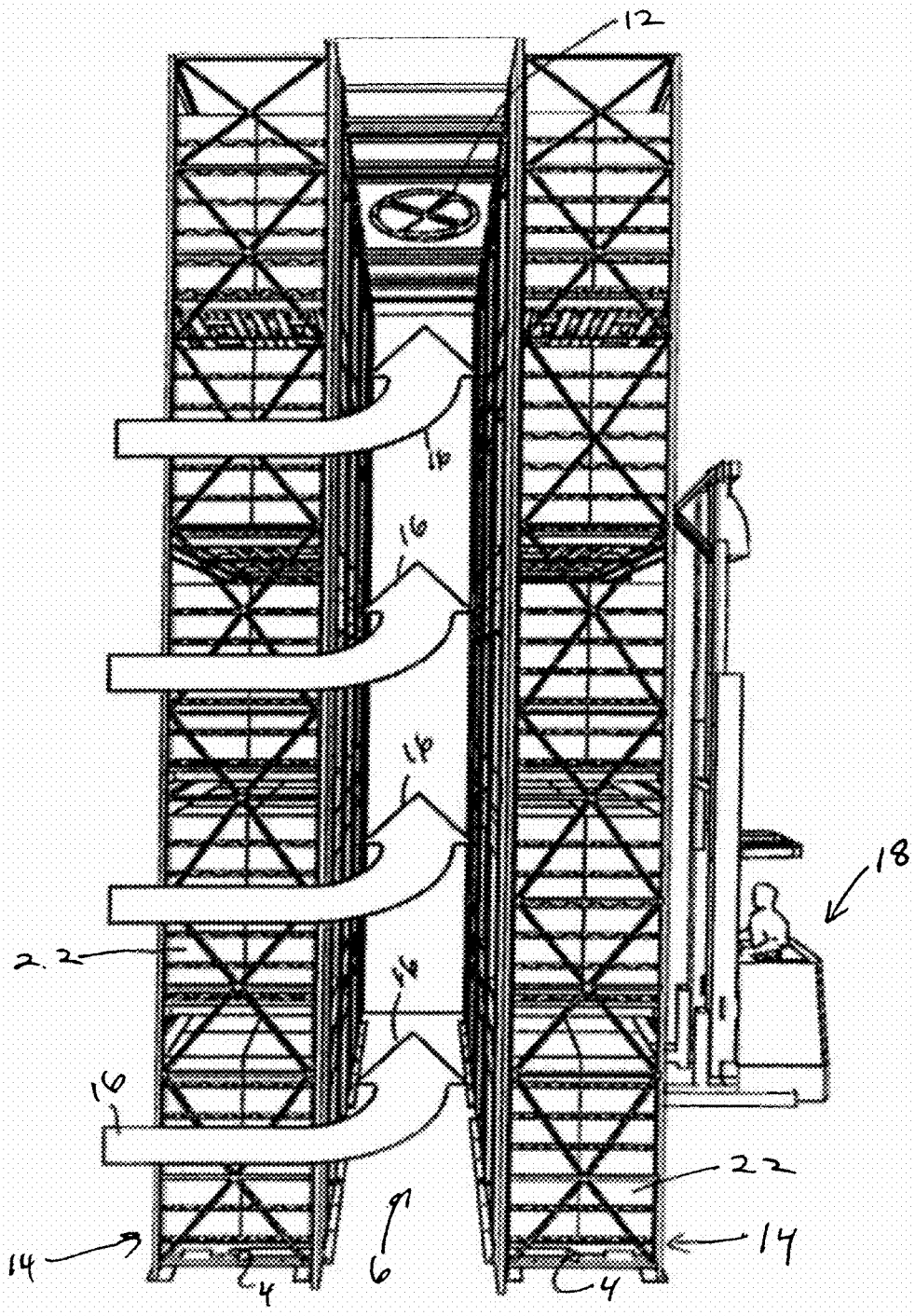
FIG. 4 is a perspective end view showing a racking arrangement.

An end view of chamber 6 with racking 14 on each side holding pallets 4 is shown in FIG. 4. As further illustrated, fan 12 draws air in as indicated by directional arrow 16 through and around cases of product 22 on pallets 4 before entering chamber 6. End cap 15 has been removed from this view, but otherwise prevents air from entering chamber 6 at the end of the row. It is appreciated that in this illustrative embodiment, storage management in warehouse 2 can also be improved by using a single pallet deep configuration. There is now more room for forklift 18 to maneuver, as well as pick and stack product.

Figure 5:
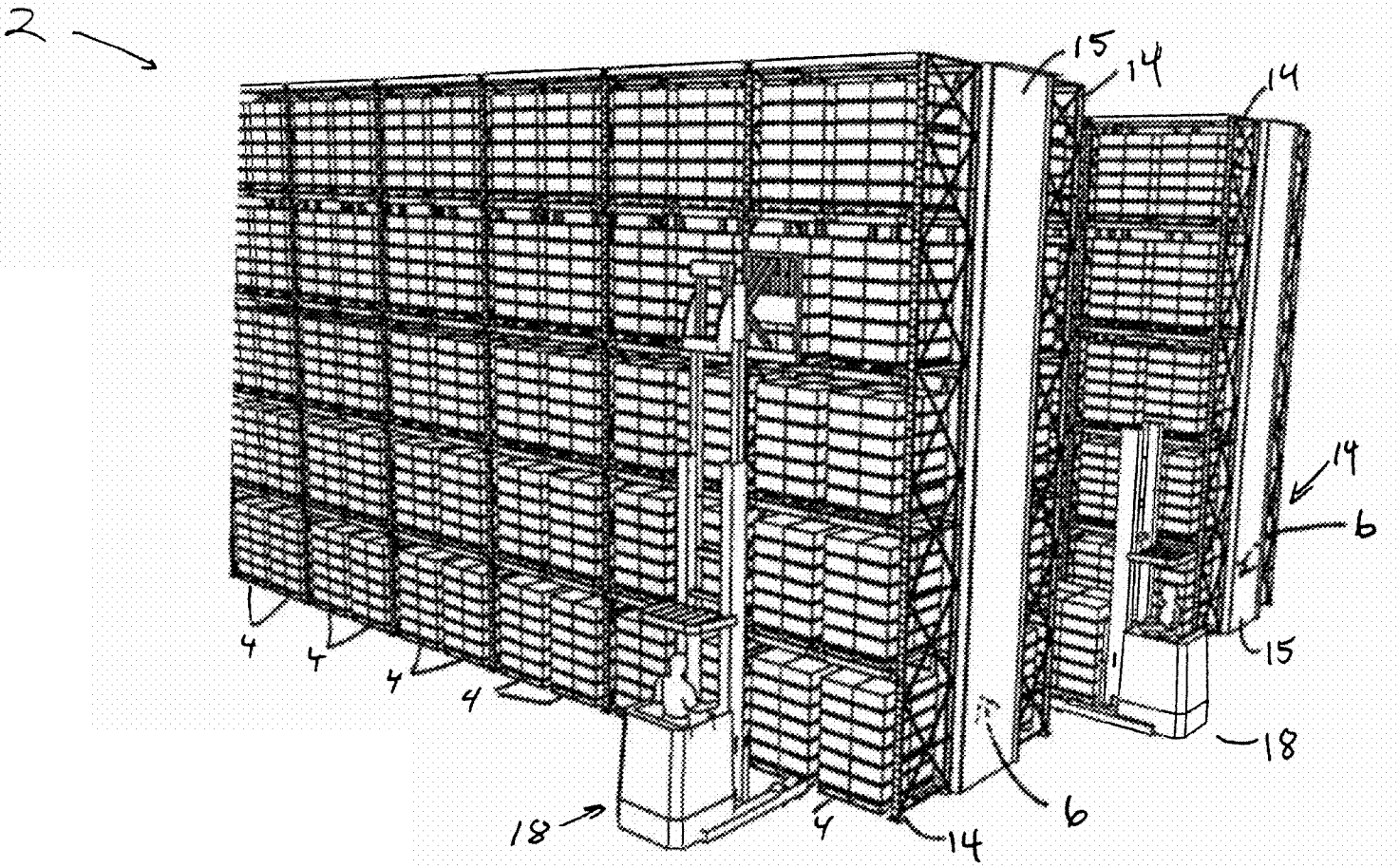
FIG. 5 is a perspective view of two rows of racking.

Another perspective view of chamber 6 located between rows of racking 14 is shown in FIG. 5. This view further demonstrates the ease within which pallets 4 of product can be accessed by forklift 18 during freezing or while maintaining their frozen condition. Conventional cooled warehouses store their pallets of product two or more pallets deep. This creates a less efficient stocking and retrieval system.

Figure 6:
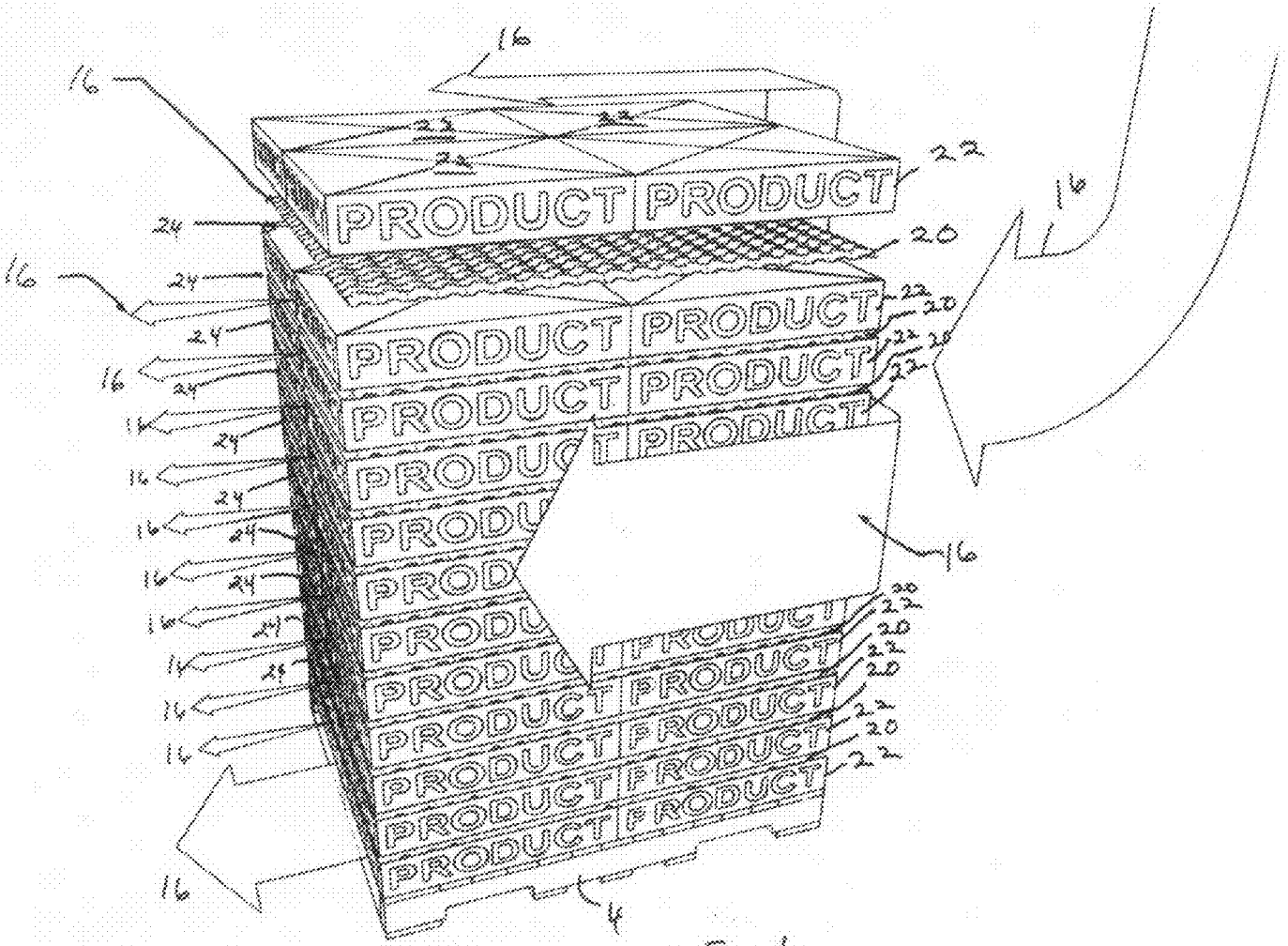
FIG. 6 is a diagrammatic perspective view showing the flow of chilling air through the palletized product.

An illustrative pallet 4 of cases 22 of product is shown in FIG. 6. In this illustrative embodiment, a freezer spacer 20 is placed between rows of individual cases 22 of product in order to provide air pathways 24. In addition, pathways 24 provide more passages through which air flow can enter chamber 6. Illustratively, spacers 20 can be made from a plastic mesh. Alternatively, they may be strips of solid material, such as wood or metal. It is contemplated that other like materials and structures can work to create air pathways by separating one row of cases 22 from another. It is further appreciated that some containers, such as turkey and ham boxes, for example, are fabricated with holes in the sides intended to allow air-flow for quicker freezing. Stacks of these cases may not require the spacers in order to freeze properly using the system disclosed herein.

Figure 7:
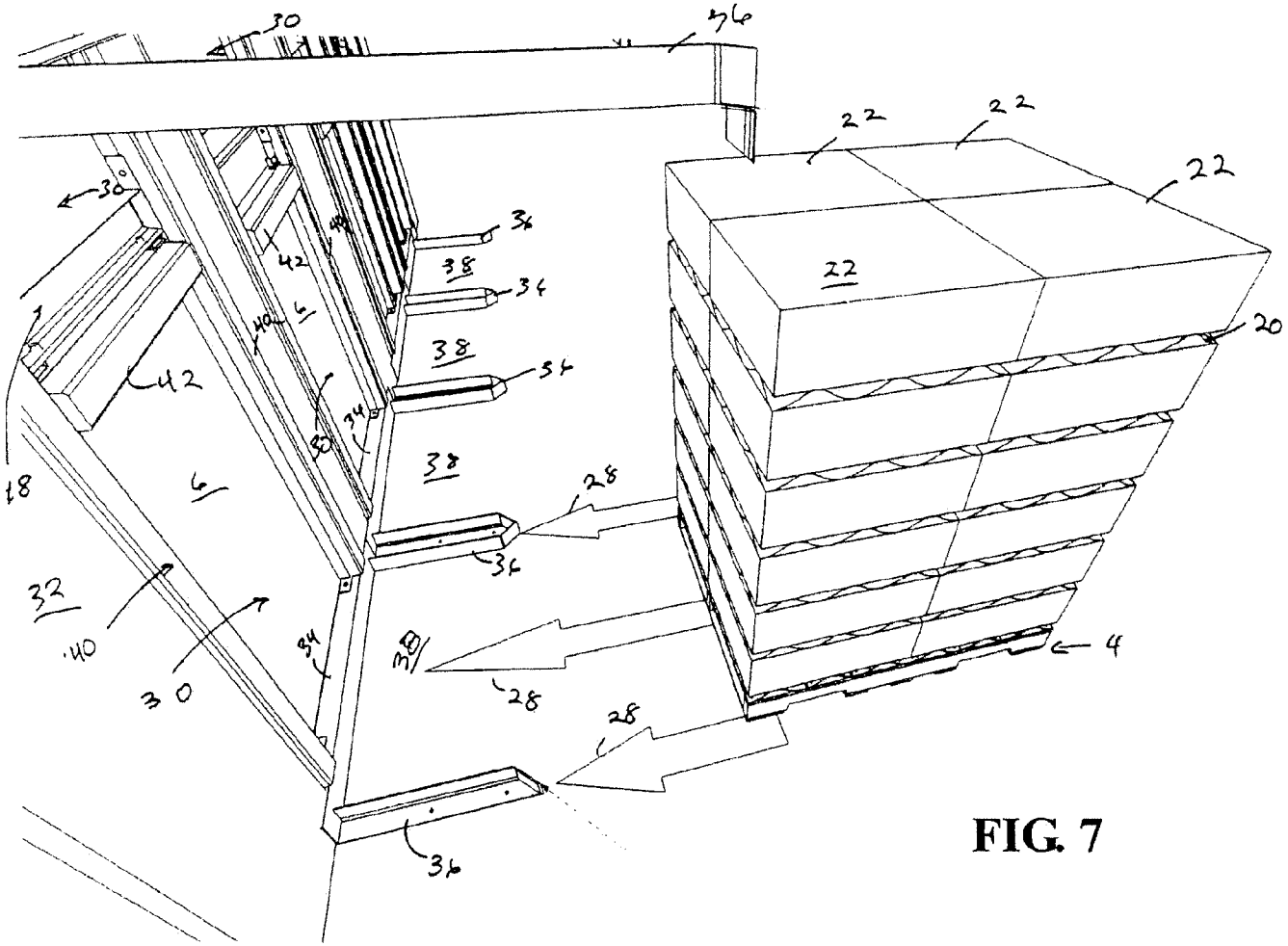
FIGS. 7 and 8 show loading of the palletized product into the racks.

A perspective view of a pallet 4 supporting a plurality of cases 22 and moving in direction 28 toward chamber 6 is shown in FIG. 7. To assist facilitating moving the chilled air from warehouse 2 into chamber 6, a plurality of openings 30 are positioned in wall 32 of racking 14. Wall 32 along with covers 17 and end cap 15 form chamber 6 (see, also, FIG. 3). In this embodiment, pallet 4 is positioned against periphery 34, 40, and 42 of air intake opening 30 preventing air from entering chamber 6 except through and around cases 20. To assist in this endeavor, spaced apart pallet support guides 36 are positioned at the illustratively lower end periphery 34. The space 38 between pallet guides 36 receives pallet 4 ensuring stacked cases 22 will be properly positioned in front of opening 30. It is appreciated that, as seen in FIGS. 4 and 5, for example, pallets can be stacked vertically. It is further appreciated that for each pallet 4 there is a pair of pallet guides 36 or like structures to help guide it to the opening. It is also appreciated that there can multiple openings 30 both vertically and laterally along both sides of chamber 6 that employ multiple pairs of channel guides 36.

Figure 8:
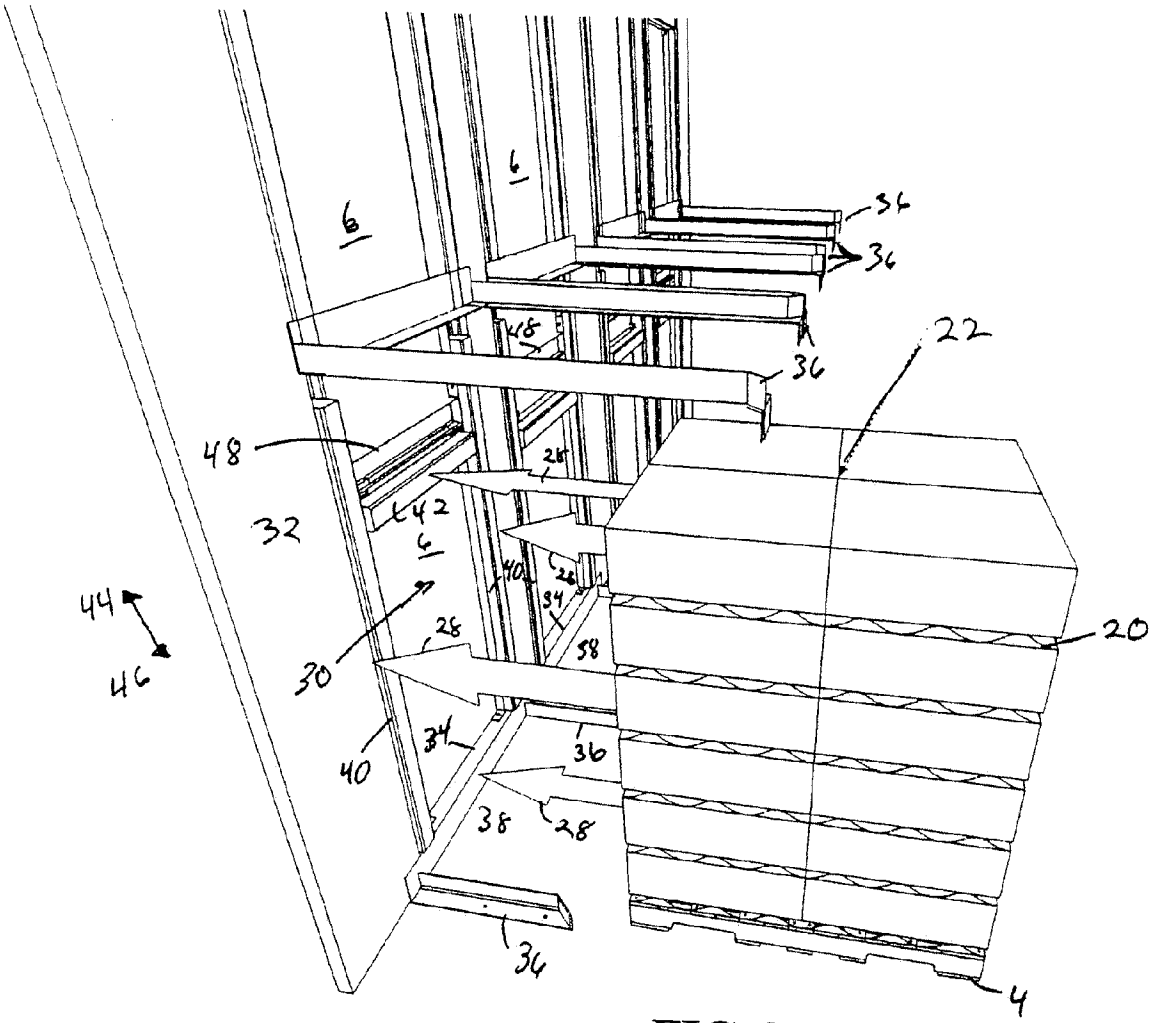

Another perspective view of pallet 4 moving in direction 28 towards opening 30 is shown in FIG. 8. This view shows seals 40 and 42 positioned about the periphery 34, 40, and 42 of opening 30. It is appreciated that cases 22 will abut against seals 34, 40, and 42 to mitigate the potential for air to enter chamber 6 adjacent wall 32, without first going over and around cases 22. It is further appreciated that there can be upper and lower horizontal seals 42 and 34, respectively, that abut the top and bottom rows of cases 22 on pallet 4.

It is further appreciated that seal 42 can be selectively vertically adjustable in directions 44 and 46 via adjustable bracket 48 to abut the top row of cases 22 on pallet 4. In the illustrative embodiment, bracket 42 may include detents, pins, or other structures that selectively engage corresponding recesses, holes, etc., to secure bracket 48 to a desired height. This flexibility is useful because depending on the product being frozen, the pallet height may vary. Directing airflow through and around cases 22 on pallet 4 means it is preferable not to have an opening either above or below the product which would create a non-desirable path of least resistance for the air to flow to enter chamber 6. It is contemplated that for each stack of pallets, adjustable panel 48 can be moved to the desired position depending on the height of cases 22. This view also shows a second upper row storage system for pallets 4 that includes additional pallet guides 36 to assist maintaining proper positioning of pallets 4 along a column. It is further contemplated that additional adjustment brackets can be moved to the appropriate location that directs air through pallets 4, rather than just around them. It is still further appreciated that the configuration of racking 14 with openings 30 and guides 36 can all be configured to accommodate conventional palleting and pallet stacking systems used in a variety of warehouse environments.

Figure 9:
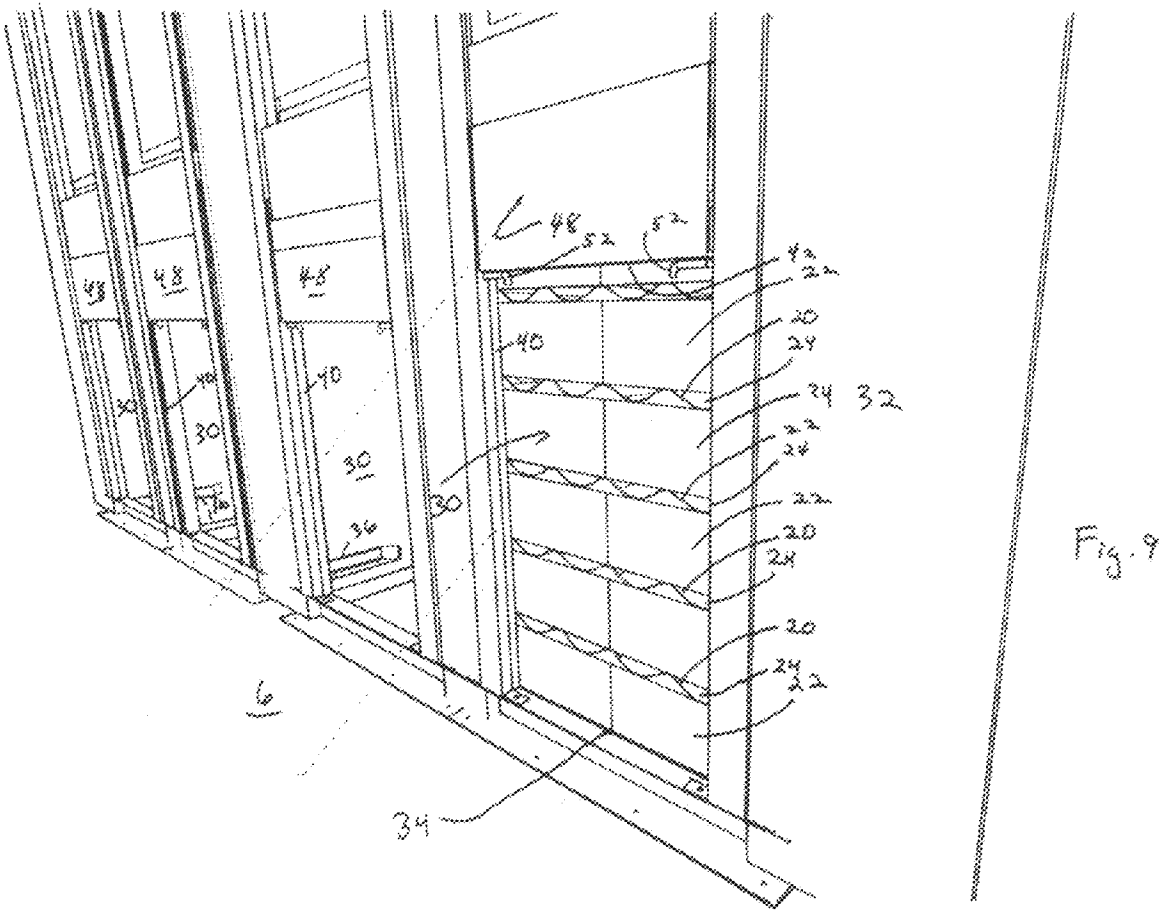
FIG. 9 is a perspective view of the racking structure as seen from the interior air chamber.

A perspective view inside chamber 6 looking toward opening 30 with pallet 4 and cases 22 pushed up against seals 34, 40 and 42 is shown in FIG. 9. From this perspective, it is appreciated that the combination of cases 22, spacers 20, and seals 34, 40 and 42 generally prevent airflow from entering chamber 6 except through space 24 created by spacers 20. This embodiment also shows a panel 48 placed above pallet 4 preventing air from simply entering chamber 6 above cases 22. It is appreciated that panel 48 is not only adjustable, but can also be either separate or attached to seal 42 as needed to provide the flexibility allowing stacked pallets 4 of a variety of heights to limit airflow into chamber 6. This view also shows illustrative panel 48 and pins 52 that illustratively engage the periphery 30 of periphery 34 to selectively hold panel 48 in place. It is appreciated that a variety of latches, clasps, etc., can be used to hold structures that prevent air from flowing into chamber 6 from undesired regions. This view shows additional panels 50 along the row of racking 14 that are configured to receive additional pallets that are subject to the same restriction of airflow flowing through the cases 22.

Figure 10:
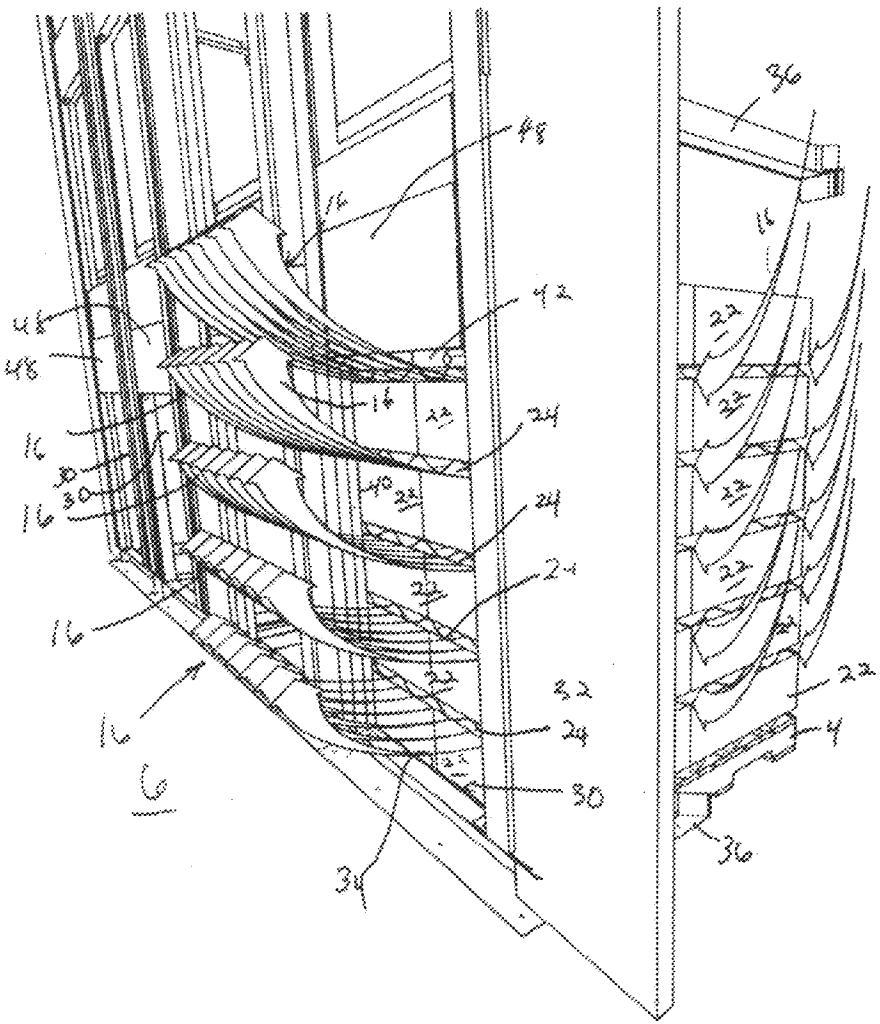
FIG. 10 is a diagrammatic view showing the flow of air through the palletized product into the interior air chamber.

Another perspective view from inside chamber 6 is shown in FIG. 10. This view demonstrates the airflow 16 that occurs when pallet 4 and cases 22 are pressed against the periphery 34, 40, and 42 of opening 30, as shown from the inside of warehouse 2. The predominate pathways are the spacings 24 created by spacers 20 between cases 22. This chilled air passes over and under each case 22 reducing their temperature until it reaches freezing. Once frozen, cold air can be used to maintain the frozen state of the product inside cases 22 until they are ready to be removed from warehouse 2.

Corresponding reference characters indicate corresponding parts throughout the several views. The exemplification set out herein illustrates an embodiment of the invention, in one form, and such exemplification is not to be construed as limiting the scope of the invention in any manner. Although the present disclosure has been described with reference to particular means, materials and embodiments, from the foregoing description, one skilled in the art can easily ascertain the essential characteristics of the invention and various changes and modifications may be made to adapt the various uses and characteristics without departing from the spirit and scope of the invention.

What is claimed is:

1. An installation for freezing and cold storage of palletized product, comprising:

a cold storage warehouse space;

at least one chiller in said warehouse space that produces freezing air and maintains the temperature of ambient air in the warehouse space below freezing;

an air flow chamber in the cold storage warehouse space air flow chamber including a plurality of air intake openings on opposite sides thereof, at least one fan in fluid communication with the air flow chamber and an air outlet opening, said at least one fan positioned and configured to draw freezing air in the cold storage warehouse space into the chamber through the air intake openings and exhaust into the warehouse space through the air outlet; and a plurality of pallet guides, each of the plurality of pallet guides sized, shaped and positioned for supporting a pallet supporting a quantity of palletized product to be frozen in sealing engagement with one of the plurality of air intake openings, whereby freezing air is drawn through the palletized product to thereby quickly freeze the product;

wherein the at least one chiller is mounted in the warehouse space remotely from the chamber.

2. The installation of claim 1, wherein the chamber has a plurality of vertically spaced horizontal rows of said air intake openings.

3. The installation of claim 2, including a plurality of seals on a periphery of said air intake openings adapted to engage the palletized product to facilitate drawing the freezing air through the palletized product.

4. The installation of claim 1, including a plurality of seals on a periphery of said air intake openings adapted to engage the palletized product to facilitate drawing the freezing air through the palletized product.

5. An installation for freezing and cold storage of palletized product, comprising:

a cold storage warehouse space;

at least one chiller in said warehouse space that produces freezing air and maintains the temperature of ambient air in the warehouse space below freezing;

a plurality of air flow chambers arranged in spaced-apart rows in the cold storage warehouse space, each said chamber having at least one air intake opening, at least one fan in fluid communication with each of the plurality of air flow chambers and an air outlet opening, said at least one fan positioned and configured to draw freezing air in the cold storage warehouse space into the chambers through the air intake opening and exhaust into the warehouse space through the air outlet; and a plurality of pallet guides arranged at the chamber openings for supporting pallets supporting a quantity of palletized product to be frozen in sealing engagement with the air intake openings, whereby freezing air is drawn through the palletized product to thereby quickly freeze the product;

said rows of chambers and their respective pallet guides being spaced apart from adjacent rows of chambers and pallet guides to form at least one aisle sufficiently wide to accommodate a forklift to pass therebetween;

wherein the at least one chiller is mounted in the warehouse space remotely from the chambers.

6. The installation of claim 5, wherein the rows of chambers are substantially parallel to each other.

7. The installation of claim 6, wherein the chambers each have a plurality of said air intake openings and respective pallet guides on opposite sides of the chambers.

8. The installation of claim 7, including a plurality of seals on a periphery of said air intake openings adapted to engage the palletized product to facilitate drawing the freezing air through the palletized product.

9. The installation of claim 6, including a plurality of seals on a periphery of said air intake openings adapted to engage the palletized product to facilitate drawing the freezing air through the palletized product.

10. The installation of claim 5, including a plurality of seals on a periphery of said air intake openings adapted to engage the palletized product to facilitate drawing the freezing air through the palletized product.

11. A method for quickly freezing palletized product in a cold storage warehouse space, comprising:

producing flowing freezing air by means of at least one chiller in the cold storage warehouse space to thereby cool ambient air within the warehouse space to a subfreezing temperature;

providing an airflow chamber in the cold storage warehouse space that is substantially sealed and has a plurality of air intake openings on opposite sides thereof;

positioning a plurality of palletized product stacks against the air intake openings in the cold storage warehouse space; and creating a negative air pressure within the airflow chamber to thereby draw freezing ambient air from the warehouse space through the palletized product and through the air intake openings to thereby freeze the product.

12. The method of claim 11, wherein the chiller is located remotely from the chamber.

13. The method of claim 12, wherein said step of positioning the plurality of palletized product stacks against the air intake openings comprises pressing the palletized product stacks against a plurality of seals located on a periphery of the air intake openings.

14. The method of claim 11, wherein said step of positioning the plurality of palletized product stacks against the air intake openings comprises pressing the palletized product stacks against a plurality of seals located on a periphery of the air intake openings.

15. The method of claim 11, including:

providing a plurality of the air flow chambers, which chambers are arranged in spaced-apart rows forming aisles therebetween; and positioning the palletized product stacks against the air intake openings by means of a forklift that moves down the aisles.

16. The method of claim 15, wherein the chambers have vertically spaced horizontal rows of the air intake openings.

17. The method of claim 11, wherein the chambers have vertically spaced horizontal rows of the air intake openings.

18. An installation for chilling and cold storage of palletized product, comprising:

a cold storage warehouse space;

at least one chiller in said warehouse space that produces cold air and maintains the temperature of ambient air in the warehouse space at a temperature sufficient to chill the product;

an air flow chamber in the cold storage warehouse space, the air flow chamber including a plurality of air intake openings, at least one fan in fluid communication with the air flow chamber and an air outlet opening, said at least one fan positioned and configured to draw the ambient air in the warehouse space into the chamber through the air intake openings and exhaust into the warehouse space through the air outlet;

a plurality of pallet guides, each of the plurality of pallet guides sized, shaped and positioned for supporting a pallet supporting a quantity of palletized product to be chilled in sealing engagement with the air intake openings, whereby cold air is drawn through the palletized product to thereby quickly chill the product;

wherein the at least one chiller is mounted in the warehouse space remotely from the chamber; and wherein the chamber has a plurality of said air intake openings on opposite sides thereof.

19. An installation for chilling and cold storage of palletized product, comprising:

a cold storage warehouse space;

at least one chiller in said warehouse space that produces cold air and maintains the temperature of ambient air in the warehouse space at a temperature sufficient to chill the product;

a plurality of air flow chambers arranged in spaced-apart rows in the cold storage warehouse space, each said chamber having at least one air intake opening, at least one fan in fluid communication with said chamber and an air outlet opening, said at least one fan positioned and configured to draw the ambient cold air in the cold storage warehouse space into the chambers through the air intake openings and exhaust into the warehouse space through the air outlets; and a plurality of pallet guides arranged at the chamber openings, each of the plurality of pallet guides sized, shaped and positioned for supporting a pallet supporting a quantity of palletized product to be chilled in sealing engagement with the air intake openings, whereby ambient cold air is drawn through the palletized product to thereby quickly chill the product;

said rows of chambers and their respective pallet guides being spaced apart from adjacent rows of chambers and pallet guides to form at least one aisle sufficiently wide to accommodate a forklift to pass therebetween;

wherein the at least one chiller is mounted in the warehouse space remotely from the chambers.

20. The installation of claim 19, wherein the chambers each have a plurality of said air intake openings and respective pallet guides on opposite sides of the chambers.

* * * * *